United States Patent [19]

Hinzmann

[11] 4,383,435

[45] May 17, 1983

[54] METHOD AND APPARATUS FOR MONITORING THE LOCATIONS OF PERFORATIONS IN WEBS OF WRAPPING MATERIAL FOR FILTER CIGARETTES OR THE LIKE

[75] Inventor: Alfred Hinzmann, Weams, Va.

[73] Assignee: Hauni-Werke Körber & Co. KG, Hamburg, Fed. Rep. of Germany

[21] Appl. No.: 261,956

[22] Filed: May 8, 1981

[51] Int. Cl.[3] ..... G01B 13/04

[52] U.S. Cl. ..... 73/37.7; 250/548

[58] Field of Search ..... 73/37.7, 37.6, 157, 73/159; 356/429; 250/548, 559, 560, 561, 562, 571, 572

[56] References Cited

U.S. PATENT DOCUMENTS

| | | | |
|---|---|---|---|
| 2,203,706 | 6/1940 | Stockbarger | 356/429 X |
| 2,884,495 | 4/1959 | Frankel | 73/37.7 X |
| 3,323,700 | 6/1967 | Epstein et al. | 250/548 X |

*Primary Examiner*—E. R. Kazenske
*Assistant Examiner*—Joseph W. Roskos
*Attorney, Agent, or Firm*—Kontler, Grimes & Battersby

[57] ABSTRACT

Rows of perforations which are produced in a plant for the making of webs of tipping paper for use in filter tipping machines are monitored by pneumatic or photoelectronic devices to ascertain the distance between such rows and the nearest marginal portions of the web while the web is transported toward the paster in a filter tipping machine. If the distance between the perforations and the marginal portion deviates from the desired distance, if the perforations are absent and/or if the combined cross-sectional area of perforations per unit length of the web is unsatisfactory, the monitoring system generates signals which are used to warn the attendants so that the attendants can replace the defective web with a satisfactory web and/or to effect segregation of filter cigarettes embodying defective portions of the web.

17 Claims, 3 Drawing Figures

METHOD AND APPARATUS FOR MONITORING THE LOCATIONS OF PERFORATIONS IN WEBS OF WRAPPING MATERIAL FOR FILTER CIGARETTES OR THE LIKE

BACKGROUND OF THE INVENTION

The present invention relates to a method and apparatus for testing webs of flexible material, especially webs of cigarette paper, imitation cork of other wrapping material for commodities which constitute or form part of smokers' products. More particularly, the invention relates to improvements in a method and apparatus for monitoring the locations of holes, pores or like openings (hereinafter called perforations) in webs of wrapping material for filter cigarettes or the like. Still more particularly, the invention relates to improvements in a method and an apparatus which can be resorted to with advantage for monitoring of the quality or condition of so-called tipping paper, i.e., wrapping material which is used in filter tipping machines to form uniting bands serving to connect plain cigarettes with filter rod sections of unit length or multiple unit length so as to convert such articles into filter cigarettes of unit length or multiple unit length.

It is well known to form tipping paper (e.g., cigarette paper or a similar flexible web- or strip-shaped material which often imitates cork) with perforations by resorting to a mechanical perforator (such as a set of needles), to a system of electrodes which generate sparks to burn holes in a web of tipping material passing through the gap or gaps between complementary electrodes, or to one or more lasers or other sources of coherent radiation. The art is replete with proposals to make perforations in such material, and the purpose of perforations is to allow a certain amount of cool atmospheric air to flow into the column of tobacco smoke, it being believed or hoped that that the atmospheric air will reduce the percentage of nicotine, condensate and/or other deleterious ingredients of tobacco smoke which reach the mouth and/or the lungs of the smoker. The perforations in tipping paper can be formed at the plant where such paper is produced and rolled to form bobbins or reels which are transported to the tobacco processing plants for use as uniting bands in filter tipping or analogous machines. It is also possible to form perforations in cigarette paper which is used to form wrappers around rod-like fillers of tobacco, i.e., to form plain cigarettes of desired length. As a rule the perforations are close to that end of a cigarette which is to be inserted into the mouth, and the combined cross-sectional area of such perforations must closely approximate or match an optimum value which is considered to produce best results as far as the reduction of danger of tobacco smoke to the health of the smoker is concerned.

In a filter tipping machine, the web of perforated tipping material is transported along a paster which coats selected portions of the web (such portions are not supposed to include the portions which are provided wth perforations) with a suitable adhesive before the web is subdivided into discrete uniting bands which are then draped around filter plugs and around the adjacent end portions of plain cigarettes. In many instances, the tipping paper has two rows or groups of rows of perforations each of which is adjacent to a different marginal portion of the web. This is necessary in filter tipping machines which are designed to make filter cigarettes of double unit length. Such cigarettes are thereupon severed midway between their ends so that each thereof yields two discrete filter cigarettes of unit length. The severing takes place midway between the axial ends of the convoluted uniting band, and each half of the band must be provided with a group of perforations, preferably close to the locus where the filter plug of unit length abuts against the adjacent end portion of the plain cigarette. Reference is made here to filter tipping machines of the type known as MAX and MAX S which are produced by the assignee of the present invention and are designed to make filter cigarettes of double unit length which are thereupon severed to yield pairs of filter cigarettes of unit length.

As mentioned above, it is considered important and desirable to ensure that the convoluted uniting band of each and every filter cigarette exhibit a predetermined permeablilty which matches or at least closely approximates a desirable optimum or presumably optimum value. This can be achieved by ensuring that the perforated zone or zones of tipping paper are not coated with adhesive because the adhesive (irrespective of whether a wet adhesive or a hotmelt) will clog at least some of the perforations so that the permeability of such tipping paper to air downstream of the paster is less than the permeability of tipping paper which has been coated with adhesive only in the regions that are remote from the perforated region or regions. Since the tipping paper is normally, or at least often, perforated in the manufacturing plant where the paper is made rather than in the cigarette making factory, the measures which the maker of cigarettes can undertake to avoid unsatisfactory coating with adhesive include proper guidance of the web of tipping paper during travel along the paster. However, this prevents the application of adhesive only if the position of perforations in the running web of tipping material is always the same, i.e., if the perforations are located at a prescribed or anticipated distance from the marginal portions of the web. In the absence of predictability in the positions of perforations with reference to the marginal portions of the web, the paster is likely to apply adhesive to perforated regions even if the web of tipping paper is guided with the utmost degree of accuracy.

It has been found that the locations of perforated zones in successive webs of tipping paper often deviate, quite pronouncedly, from optimum locations. This brings about the aforediscussed disadvantages as well as many others. Thus, not only is the paster likely to clog some or all of the perforations in the running web of tipping paper but the perforations can be too close to the lip ends of filter mouthpieces in filter cigarettes so that they are likely to be sealed by the lips of the smoker. Moreover, and if the perforations are of such size and/or shape that they can be seen with the naked eye, improperly applied and/or distributed perforations (or the adhesive paste penetrating through such perforations) will detract from the eye-pleasing appearance of the smokers' products. A manufacturer who relies on accuracy in the positions of perforations in the webs of tipping paper is likely to produce huge quantities of filter cigarettes with unsatisfactory ventilating (air-admitting) zones or to produce filter cigarettes which are totally devoid of ventilation zones. It must be borne in mind that a modern cigarette maker or filter tipping machine can turn out up to and in excess of 100 cigarettes per second, and that a single bobbin or reel of tipping paper with unsatisfactory perforations is likely to cause huge losses in output or the production of large quantities of unsatisfactory smokers' products. Spot checking of such products, even at relatively frequent intervals, does not appreciably reduce the number of rejects in view of the aforementioned extremely high output of modern cigarette makers and like machines. On the other hand, testing of each and every product for the presence of absence of satisfactory ventilation zones is a very complex and costly procedure, especially if such testing must be performed in addition to customary testing which involves detection of frayed ends of wrappers, large holes in the wrappers, open ends, absence of sufficiently dense ends and similar defects which are normally detected in heretofore known testing devices forming part of or cooperating with cigarette making, filter rod making or filter tipping machines. Furthermore, if a cigarette having an unsatisfactory ventilation zone is detected in or after it is removed from the maker, the machine is likely to have produced an enormous quantity of unsatisfactory rod-shaped articles before the cause of defect is detected and eliminated.

OBJECTS AND SUMMARY OF THE INVENTION

An object of the invention is to provide a novel and improved method of reliably ascertaining the quality of a web of tipping paper or like flexible material, especially for ascertaining the presence or absence of one or more ventilating zones therein and/or whether the ventilating zone or zones are properly applied or formed so as to warrant the utilization of such material in a cigarette making, filter rod making, filter tipping or analogous machine.

Another object of the invention is to provide a method of testing tipping paper or the like for the accuracy of positioning or location of perforated zones which admit atmospheric air into the finished products.

A further object of the invention is to provide a method which reduces the likelihood of clogging of perforations in a web of tipping paper or the like with adhesive prior to conversion of such material into uniting bands for filter plugs and plain cigarettes in filter tipping machines.

An additional object of the invention is to provide a method which renders it possible to detect web portions with improperly formed or positioned perforated regions practically immediately and well ahead of the station or stations where the web is converted into uniting bands.

Still another object of the invention is to provide a method of the above outlined character which can be used for reliable detection of web portions with improperly applied or positioned perforated zones, even if the web is not guided with a high degree of accuracy.

A further object of the invention is to provide a method whch ensures that the articles which embody defective portions of the web can be readily detected and segregated from satisfactory articles.

Another object of the invention is to provide a method which can be practiced in connection with monitoring of the condition or quality of relatively wide or relatively narrow webs as well as of webs which are formed with a single row of perforations or with two or more rows of perforations.

An additional object of the invention is to provide a novel and improved apparatus which can be utilized for the practice of the above outlined method and which is constructed and assembled in such a way that it can be installed in or associated with many types of existing high-speed machines for the production of plain or filer tipped cigarettes, filter rod sections and analogous commodities which constitute or form part of smokers' products.

Another object of the invention is to provide an apparatus which can reliably detect the defective portions of a running web of tipping paper or the like, even if the paper is not guided with a high degree of accuracy.

A further object of the invention is to provide the apparatus with novel and improved means for enabling the attendants to undertake the necessary corrective measures practically without any delay upon detection of a defective portion of a running web of tipping paper or the like.

Another object of the invention is to provide an apparatus which can monitor a rapidly running web of tipping paper or the like for the accuracy of locations of perforations therein, for the absence or presence of perforations, as well as for the size (combined cross-sectional area) of perforations per unit length of the running web.

An ancillary object of the invention is to provide an apparatus of the above outlined character which can initiate and effect segregation of any and all smokers' products which contain or embody portions of defective webs of tipping paper or the like.

An additional object of the invention is to provide an apparatus of the above outlined character which can ascertain the locations and quality of perforations in any one of several ways, such as pneumatically, optoelectronically or by resorting to a combination of the just enumerated techniques.

A further object of the invention is to provide a monitoring apparatus which can be readily installed in or associated with existing filter tipping or analogous machines with a minimum of expenditures for modifications of such machines.

Another object of the invention is to provide an apparatus which reduces the likelihood that a filter tipping or like machine will permit a defective article to leave with satisfactory articles, i.e., to enter the storage or a packing machine together with articles whose wrappers are formed with acceptable ventilation zones for admission of atmospheric air into tobacco smoke when the articles are lighted.

An additional object of the invention is to provide an apparatus which exhibits some or even all of the above outlined features in spite of its relative simplicity, compactness, reliability and reasonable cost.

A further object of the invention is to provide the apparatus with novel and improved means for generating signals in response to detection or absence of detection of perforations and with novel and improved means for processing, evaluating and utilizing such signals.

One feature of the invention resides in the provision of a method of processing a running web of wrapping material having at least one row of perforations which are normally disposed at a given distance from a marginal portion of the web, particularly of processing a running web of tipping paper in a filter tipping machine ahead of the station at which at least one selected portion of one side of the web is coated with a suitable adhesive (e.g., a wet adhesive or a hotmelt). The method comprises the steps of monitoring the distance between the marginal portion and the row of perforations in the running web, and automatically generating a signal when the monitored distance between the row of perforations and the marginal portion deviates from the given distance.

In accordance with one presently preferred embodiment of the method, the latter further comprises the step of transporting the marginal portion of the web lengthwise along a predetermined path so that those perforations which are located at the aforementioned given distance from the marginal portion advance along a second path which is separated from the predetermined path by the aforementioned given distance. The monitoring step then comprises scanning the second path for the presence of acceptable perforations and/or for the presence of any perforations, and the signal generating step then comprises automatically generating a signal on detection of the absence of satisfactory perforations or on detection of the absence of perforations in the second path.

The monitoring step can include the steps of establishing a pressure differential between the opposite sides of the running web, at least in the region which is disposed at the aforementioned given distance from the marginal portion of the web, whereby the pressure differential deviates from a predetermined value in the absence of perforations or in the presence of unsatisfactory perforations in the aforementioned region, and monitoring the pressure differential. The signal generating step then includes generating a signal whenever the monitored pressure differential deviates from the predetermined value. The step of establishing a pressure differential can include normally maintaning the pressure at one side of the running web below atmospheric pressure. However, it is equally within the purview of the improved method to maintain the pressure at one side of the running web above atmospheric pressure, or to maintain one side of the web above and the other side of the web below atmospheric pressure. As a rule, the step of monitoring the pressure differential will involve ascertaining the actual pressure differential in the region of anticipated location of a row of perforations, and comparing the ascertained pressure differential with the predetermined value (e.g., by resorting to a threshold circuit or to another suitable signal comparing stage).

In accordance with another presently preferred embodiment of the method, the latter further comprises the step of transporting the web lengthwise along a predetermined path wherein the positions of the marginal portion and of the row of perforations are likely to vary, as considered transversely of the running web. The monitoring step then includes continuously monitoring the position of the marginal portion of the running web (as considered transversely of the web), continuously monitoring the position of the row of perforations (as considered transversely of the running web), and continuously comparing the distance between the positions of the marginal portion and the row of perforations with the given distance. Such method can be carried out by utilizing a first battery of photocells for monitoring the position of the marginal portion and a second battery of photocells for monitoring the position of the row of perforations. In other words, at least one of the just mentioned continuous monitoring steps can involve optical scanning of the position of the corresponding part (marginal portion or row of perforations) of the running web.

If the running web has several rows of perforations, e.g., the aforediscussed row of perforations which is normally located at the given distance from the aforementioned marginal portion as well as a second row of perforations which are normally located at a second given distance from such marginal portion, the method may further comprise the steps of monitoring the distance between the second row of perforations and the marginal portion, and of automatically generating a discrete second signal when the distance between the marginal portion and the second row of perforations deviates from the second given distance. The just mentioned method can be resorted to when the web has two rows of perforations so that each uniting band which is obtained on severing of the web subsequent to the application of adhesive also exhibits two rows of perforations. Each uniting band is converted into a tube surrounding a filter plug of double unit length and the adjacent portions of two plain cigarettes of double unit length, and the resulting filter cigarette of double unit length is converted into two filter cigarettes of unit length each having a plain cigarette of unit length, a filter plug of unit length and one-half of the respective convoluted uniting band with one row of perforations therein. The signals which are obtained on monitoring of the perforations can be used to effect segregation of filter cigarettes having unsatisfactory convoluted uniting bands from the path of satisfactory cigarettes and/or to inform the operators that the reel which supplies the web having one or more unsatisfactory rows of perforations must be replaced with a fresh reel wherein each row of perforations is located at the desired or optimum distance from the selected marginal portion. Since the width of the web is normally constant, it is equally possible to monitor the distance between a first row of perforations and one marginal portion of the running web and to simultaneously monitor the distance between the second row of perforations and the other marginal portion of the running web. The distance between a first row of perforations and one marginal portion of the web normally matches the distance between the second row of perforations and the other marginal portion.

It goes without saying that the method can be used with equal advantage for the processing of webs wherein each row of perforations is a composite row having several files of accurately or substantially accurately aligned perforations (as considered in the longitudinal direction of the web). The perforations can be formed by resorting to mechanical perforating means, by resorting to spark generating means, or by resorting to one or more lasers or other suitable sources of coherent radiation.

The novel features which are considered as characteristic of the invention are set forth in particular in the appended claims. The improved apparatus itself, however, both as to its construction and its mode of operation, together with additional features and advantages thereof, will be best understood upon perusal of the following detailed description of certain specific embodiments with reference to the accompanying drawing.

DESCRIPTION OF THE PREFERRED EMBODIMENTS

Figure 1:
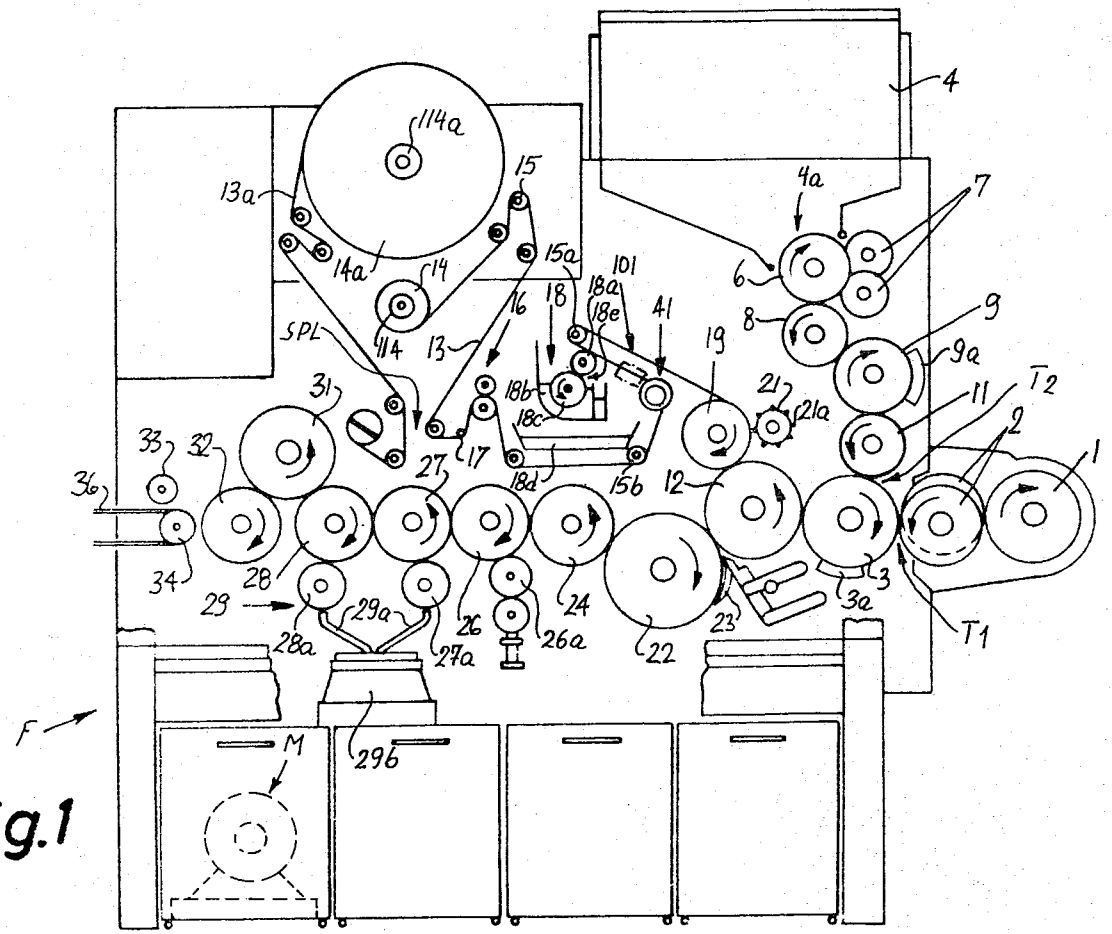
FIG. 1 is a somewhat schematic front elevational view of a filter tipping machine which is equipped with apparatus embodying the present invention and serving to monitor the locations as well as the presence or absence of perforations in a web of tipping paper.

Referring first to FIG. 1, there is shown a filter tipping machine of the type known as MAX S which is manufactured and sold by the assignee of the present application. The construction of the filter tipping machine, which is directly coupled to a cigarette making machine (for example, a machine known as SE 80 manufactured and sold by the assignee of the present application), is as follows:

The frame F of the filter tipping machine supports a rotary drum-shaped conveyor 1 which can be said to form part of the aforementioned cigarette making machine and delivers two rows of plain cigarettes of unit length to a pair of staggered rotary drum-shaped aligning conveyors 2. The plain cigarettes of one row of cigarettes in the axially parallel peripheral flutes of the row forming conveyor 1 are adjacent to one axial end, and the plain cigarettes of the other row are adjacent to the other axial end of this conveyor. Furthermore, the cigarettes of one row are transported by oddly numbered flutes whereas the cigarettes of the other row are transported by evenly numbered flutes of the conveyor 1. The two rows of cigarettes are transferred into the peripheral flutes of the corresponding aligning conveyors 2 which rotate in a counterclockwise direction, as viewed in FIG. 1, and are driven at different speeds and/or transport the respective cigarettes through different distances so that, when a flute of the front aligning conveyor 2, as viewed in FIG. 1, reaches a transfer station T1, it is in accurate axial alignment with a flute of the rear aligning conveyor 2. Such flutes deliver a pair of coaxial plain cigarettes of unit length into the adjacent flute of a rotary drum-shaped assembly conveyor 3 which is driven to rotate in a clockwise direction, as viewed in FIG. 1.

The top portion of the frame F supports a magazine 4 for a supply of parallel rod-shaped filter rod sections (not specifically shown) of six times unit length. The outlet opening 4*a* at the lower end of the magazine 4 receives a portion of a rotary drum-shaped severing conveyor 6 which is driven to rotate in a clockwise direction, as viewed in FIG. 1, and has peripheral flutes extending in parallelism with its axis. Such flutes remove from the magazine 4 discrete filter rod sections of six times unit length and transport successive filter rod sections past two rotary disc-shaped knives 7 which rotate about parallel axes and are staggered with respect to each other, as considered in the axial direction of the severing conveyor 6. The conveyor 6 cooperates with the knives 7 to convert successive filter rod sections of six times unit length into sets of three coaxial filter plugs of double unit length, and the filter plugs of successive sets are transferred onto a rotary staggering conveyor 8. The conveyor 8 is assembled of three discs which may but need not rotate about a common axis and are driven at different speeds and/or transport the respective filter plugs through different distances so that the filter plugs of each set are staggered with respect to each other, as considered in the circumferential direction of the conveyor 8, prior to transfer of successive filter plugs of double unit length into successive peripheral flutes of a rotary drum-shaped shuffling conveyor 9. The conveyor 9 is driven to rotate in a clockwise direction, as viewed in FIG. 1, and cooperates with two stationary cams 9*a* (only one shown) to convert the single row of axially staggered filter plugs into a row wherein each preceding filter plug is in accurate alignment with the next-following plug prior to transfer of successive plugs of the thus obtained row into successive flutes of a combined accelerating and inserting conveyor 11. The conveyor 11 is a rotary drum whose flutes deliver filter plugs of double unit length into successive flutes of the assembly conveyor 3 at a second transfer station $T_2$ which is located upstream of the transfer station $T_1$. The pairs of plain cigarettes of unit length which are delivered into the flutes of the assembly conveyor 3 at the transfer station $T_1$ are spaced apart from each other by a distance which at least equals the axial length of a filter plug of double unit length, and the inserting conveyor 11 delivers filter plugs into successive flutes at the station $T_2$ in such positions that, upon arrival at the transfer station $T_1$, the filter plugs are located in the gaps between the corresponding plain cigarettes of unit length. The assembly conveyor 3 advances the thus obtained groups of three coaxial rod-shaped articles each through the space between two suitably configurated condensing cams 3*a* (only one shown) which cause the plain cigarettes to move axially toward each other and into abutment with the respective end faces of the corresponding filter plug of double unit length.

The assembly conveyor 3 delivers successive condensed groups (each such group contains two coaxial plain cigarettes of unit length and a filter plug of double unit length therebetween) into successive flutes of a rotary drum-shaped transfer conveyor 12. This conveyor further receives adhesive-coated uniting bands from a rotary drum-shaped suction conveyor 19 which cooperates with the blades 21*a* of a rotary cutter 21. The cams 3*a* can be placed adjacent to the transfer conveyor 12 upstream of the conveyor 19.

The uniting bands are obtained in response to severing of the leader of a continuous web 13 of cigarette paper, imitation cork or another suitable flexible strip-shaped wrapping material (also called tipping paper). Such material is drawn off a reel 14 which is mounted on a spindle 114 and is caused to travel around a plurality of guide rolls 15 prior to reaching a so-called curling device 17 of the type disclosed in commonly owned U.S. Pat. No. 3,962,957 granted Jun. 15, 1976 to Alfred Hinzmann. After advancing beyond the curling device 17, successive increments of the web 13 enter the nip of two advancing rolls 16 at least one of which is driven to advance the web in a direction toward the suction conveyor 19. The leader of the web 13 adheres to the foraminous peripheral surface of the suction conveyor 19 and is caused to advance past successive blades 21*a* of the rotating cutter 21. The latter cooperates with the conveyor 19 to convert the web 13 into a series of discrete web portions or uniting bands of predetermined length. The conveyor 19 draws the web 13 from the rolls 16 and transports the web past a roller-shaped applicator 18*a* forming part of a paster 18 which coats one side of the web 13 with a suitable adhesive. The applicator 18*a* receives adhesive from a source of supply here shown as a tank 18*b* by way of a withdrawing roll 18c and coats a portion of or the entire underside of the travelling web 13. A trough 18d which intercepts droplets of adhesive is disposed below the tank 18b of the paster 18.

The conveyor 19 applies successive discrete uniting bands to successive groups of coaxial rod-shaped articles in the oncoming flutes of the transfer conveyor 12. The uniting bands are preferably applied in such a way that they are disposed substantially tangentially of the respective groups and adhere to the corresponding filter plugs as well as to the innermost portions of the respective plain cigarettes of unit length. Such groups, each of which carries an adhesive-coated uniting band, are thereupon transferred onto the peripheral surface of a rotary drum-shaped wrapping conveyor 22 which cooperates with an adjustable (stationary or mobile) rolling device 23 to convolute the oncoming uniting bands around the respective groups so that each group constitutes a filter cigarette of double unit length.

The wrapping conveyor 22 delivers successive filter cigarettes of double unit length into successive flutes of a rotary drum-shaped drying conveyor 24 which can embody or is associated with suitable testing means for detection of filter cigarettes having defective wrappers. At least those filter cigarettes of double unit length whose wrappers are satisfactory are thereupon delivered into successive flutes of a rotary drum-shaped severing conveyor 26 which cooperates with a rotary disk-shaped knife 26a to sever each filter cigarette of double unit length midway across the filter plug so that each such cigarette yields two coaxial filter cigarettes of unit length. Each filter cigarette of unit length contains a plain cigarette of unit length, a filter plug of unit length, and one-half of a convoluted tubular uniting band which binds the filter plug of the respective plain cigarette.

The severing conveyor 26 delivers successive pairs of filter cigarettes of unit length into successive flutes of a rotary drum-shaped conveyor 27 of a turn-around device 29 of the type disclosed in commonly owned U.S. Pat. No. 3,583,546 granted to Gerhard Koop. The turn-around device 29 further comprises a second rotary drum-shaped fluted conveyor 27a which receives one filter cigarette of each pair from the conveyor 27, a third rotary drum-shaped fluted conveyor 28 which receives the other filter cigarette of each pair from the conveyor 27, a fourth rotary drum-shaped fluted conveyor 28a, and a set of orbiting arms 29a which receive motion from a driving unit 29b.

The operation of the turn-around device 29 is as follows: The conveyor 27 receives pairs of coaxial filter cigarettes of unit length from successive flutes of the severing conveyor 26. One filter cigarette of each pair is delivered into the oncoming flute of the conveyor 28, whereas the other filter cigarette of each pair enters the oncoming flute of the conveyor 27a. Successive flutes of the conveyor 27a deliver the respective filter cigarettes of unit length to oncoming arms 29a which turn each filter cigarette end-for-end and deliver the inverted cigarettes into successive flutes of the conveyor 28a. The conveyor 28a delivers the inverted filter cigarettes of unit length into alternate flutes of the conveyor 28. It is to be noted that the conveyor 27 delivers successive non-inverted filter cigarettes of unit length into alternate flutes of the conveyor 28 so that the latter provides room for acceptance of inverted cigarettes from the conveyor 28a. The arrangement is preferably such that the conveyor 28a delivers inverted filter cigarettes of unit length into the spaces between successive pairs of non-inverted cigarettes on the conveyor 28. Thus, the conveyor 28 transports a single file of aligned filter cigarettes of unit length in a clockwise direction, as viewed in FIG. 1, and the filter plugs of all filter cigarettes on the conveyor 28 face the same direction. Successive flutes of the conveyor 28 deliver successive filter cigarettes of unit length to a testing conveyor 31, for example, a conveyor of the type disclosed in commonly owned U.S. Pat. No. 3,962,906 granted June 15, 1976 to Uwe Heitmann et al. The cigarettes which are defective are segregated from satisfactory cigarettes on a rotary drum-shaped conveyor 32 which follows the testing conveyor 31 and may cooperate with an additional testing device which monitors the tobacco-containing ends of successive cigarettes. The cigarettes which are found to be defective by the testing unit including the conveyor 31 and/or by the testing unit including the conveyor 32 are segregated during travel past an ejecting device (not shown) of any known design, and the remaining (satisfactory) cigarettes of unit length are delivered onto the upper reach of an endless belt conveyor 36. The upper reach of the conveyor 36 cooperates with a braking roll 33 and this conveyor is trained over pulleys 34 of which only one is shown in FIG. 1. The upper reach of the conveyor 36 delivers satisfactory filter cigarettes of unit length into storage, directly to a packing machine, or into a reservoir system (e.g., a system of the type which is known as Resy and is manufactured and sold by the assignee of the present application).

The operation of the wrapping conveyor 22 and rolling device 23 will be understood upon perusal of the disclosure in commonly owned U.S. Pat. Nos. 3,483,873 or 3,527,234, both granted to Alfred Hinzmann.

The frame F further supports a spindle 114a for a fresh reel 14a of wrapping material 13a the leader of which is held at a splicing station SPL. When the supply of running web 13 on the reel 14 is nearly exhausted, a splicing device (not specifically shown) at the station SPL is actuated to attach the leader of the web 13a to the trailing portion of the web 13. A splicing device which can be used in the filter tipping machine of FIG. 1 is disclosed, for example, in commonly owned U.S. Pat. No. 3,730,811 granted May 1, 1973 to Hans-Joachim Wendt. The disclosures of all of the aforementioned commonly owned patents are incorporated herein by reference.

The driven parts of the filtertipping machine receive motion from a main prime mover M, e.g., a variable speed electric motor which can rotate the advancing rolls 16 and the suction conveyor 19 (i.e., the means for transporting the web 13 along an elongated path extending from the reel 14 to the transfer conveyor 12, namely, to the path for the groups of rod-shaped articles) at a plurality of different speeds.

The paster 18 is installed in the frame F at a level below a deflecting roll 15a which causes the one side of the running web 13 to contact the periphery of the roller-shaped applicator 18a of the paster 18 so that such side of the web 13 is at least partially coated with adhesive a supply of which is stored in the tank 18b. The adhesive can be an aqueous dispersion of polyvinyl acetate glue.

The apparatus which is constructed and assembled in accordance with one embodiment of the present invention is installed in the filter tipping machine of FIG. 1 upstream of the roller-shaped applicator 18a of the paster 18, i.e., it is adjacent to that portion of the path for the running web 13 which is located ahead of the adhesive applying station. The apparatus comprises a guide means 41 which serves to maintain the two marginal portions S1 and S2 of the running web 13 in or close to two predetermined planes to thus ensure that, if the two rows of perforations P1 and P2 are located at prescribed distances from the respective marginal portions S1 and S2, each row of perforations can be readily detected and its condition or quality ascertained while the corresponding portion of the web 13 advances toward the adhesive applying station. The guide means 41 is designed to change the direction of travel of the web 13 at an acute, right or obtuse angle (less than 180 degrees), e.g., at an angle of approximately 90 degrees. If the two rows of perforations P1 and P2 are located at a desired or prescribed distance from the respective marginal portions S1 and S2 of the running web 13, the perforations P1 can be monitored by a first monitoring device 42*a* and the perforations P2 can be monitored by a second monitoring device 42*b*. The distance between the monitoring devices 42*a* and 42*b* (as considered transversely of the web 13) equals the optimum or desirable distance between the row of perforations P1 and the row of perforations P2.

The paster 18 is designed in such a way that it applies adhesive to web portions which extend (as considered transversely of the web 13) between the marginal portion S1 and the row of perforations P1, between the marginal portion S2 and the row of perforations P2, and (if necessary or desired) between the row of perforations P1 and the row of perforations P2. To this end, the applicator 18*a* can have raised peripheral portions which receive films of adhesive paste from the withdrawing roll 18*c* (the latter dips into the supply of paste in the tank 18*b* so that its peripheral surface carries a film of adhesive paste toward the nip of the parts 18*a*, 18*c*). Reference may be had to commonly owned U.S. Pat. No. 4,249,547 granted Feb. 10, 1981 to Alfred Hinzmann. The disclosure of this patent is incorporated herein by reference. Alternatively, the withdrawing member 18*c* can apply adhesive paste to the entire peripheral surface of the applicator 18*a* but the latter then cooperates with suitable doctor blades (one indicated in FIG. 1 at 18*e*) serving to remove adhesive from those portions of peripheral surface of the applicator 18*a* which contact the web in regions or zones surrounding the perforations P1 and P2. This ensures that the perforations P1 and P2 are not clogged with adhesive paste during transport along the applicator 18*a* of the paster 18. Of course, the perforations P1 and/or P2 are likely to be clogged with adhesive paste if they are not located at an optimum or prescribed distance from the respective marginal portions S1 and S2.

The guide means 41 is or includes a cylindrical stub or post 43 which is rotatably or non-rotatably installed in the frame F of the filter tipping machine between rolls 15*a* and 15*b* and carries two ring-shaped flanges or collars 46 separably and adjustably secured thereto by screws 44 or analogous fasteners. The selected distance between the collars 46 equals or slightly exceeds the width of the web 13. The aforementioned monitoring devices 42*a* and 42*b* include component parts which are disposed in the space between the two flanges 46 and register with the respective perforations P1 and P2 provided, of course, that the distance between the perforations P1, P2 on the one hand and the respective marginal portions S1 and S2 on the other hand matches or closely approximates the desired or optimum distance. The just mentioned component parts include circumferentially extending arcuate grooves or recesses 47*a* and 47*b* which are machined into or otherwise formed in the stud 43 and whose length, as considered in the circumferential direction of the stub 43, is slightly or somewhat less than the length of contact between the web 13 and the peripheral surface of the stub 43. In other words, the angle along which the groove 47*a* and 47*b* extends is somewhat less than the angle of contact or wrap between the stub 43 and the web 13.

The grooves 47*a* and 47*b* respectively communicate with radially inwardly extending bores 48*a*, 48*b* which are machined into the stub 43 and whose inner end portions respectively communicate with axially parallel suction channels 49*a*, 49*b* machined into the stub 43. The stub 43 is preferably held against rotation (i.e., the web 13 is caused to slide along the peripheral surface of the stub 43) because this eliminates the need for relatively complex seals between the discharge ends of the channels 49*a*, 49*b* and conduits 51*a*, 51*b* of the two monitoring devices 42*a* and 42*b*. The conduits 51*a*, 51*b* respectively contain preferably adjustable flow restrictors 52*a*, 52*b* and their discharge ends are connected with the intake end of a common or main suction pipe or conduit 51 containing a shutoff valve 53 and connected to a suitable positive or negative pressure generating device 54. The shutoff valve 53 may be provided in addition to or it may further constitute a pressure reducing or regulating valve. The pressure of gaseous fluid which flows in the conduit 51 is monitored and indicated by a suitable gauge 56. If the device 54 is a source of compressed gaseous fluid, the grooves 47*a* and 47*b* discharge streamlets of compressed air through the respective perforations P1, P2 and into the surrounding atmosphere. If the device 54 constitutes or includes a suction generating means, the conduits 51*a* and 51*b* draw streams of air from the atmosphere, through the perforations P1, P2 and into the respective grooves 47*a*, 47*b*. All that counts is to ensure that the apparatus can establish pressure differentials between the two sides of the running web 13 in the regions of perforations P1 and P2 (or in the regions where the perforations P1 or P2 are assumed or supposed to be located) so that the monitoring means can ascertain the presence, absence and/or size of the perforations P1 and P2.

The improved apparatus further comprises pressure-voltage transducers 58*a*, 58*b* which are respectively connected with the conduits 51*a*, 51*b* upstream of the respective flow restrictors 52*a*, 52*b*. The outputs of the transducers 58*a*, 58*b* transmit signals, whose intensities and/or other characteristics are indicative of the pressure of fluid in the respective conduits 51*a*, 51*b*, to the inputs of threshold circuits 59*a*, 59*b* whose outputs are connected with signal generating lamps 62*a*, 62*b* by way of amplifiers 61*a*, 61*b*. The parts 58*a*, 59*a*, 61*a*, 62*a* can be said to constitute a first pressure detector 57*a*, and the parts 58*b*, 59*b*, 61*b*, 62*b* can be said to constitute a second pressure detector 57*b*. The threshold circuits 59*a* and 59*b* are adjusted or selected in such a way that their outputs transmit signals to the respective amplifiers 61*a* and 61*b* only when the pressure of fluid in the respective conduits 51*a* and 51*b* drops below a preselected value (it being assumed that the device 54 is a suction generating device) which is indicative that the corresponding grooves 47*a*, 47*b* are not in register with perforations P1, P2 and/or that the combined cross-sectional area of those perforations which momentarily register with the grooves 47*a* and 47*b* is insufficient to ensure the flow of adequate quantities of atmospheric air into the column of tobacco smoke in that filter cigarette FC (see FIG. 3) which embodies the corresponding portion of the web 13, i.e., which embodies the corresponding uniting band.

The outputs of the threshold circuits 59*a* and 59*b* are further respectively connected with the inputs of first stages of two shift registers 63*a*, 63*b* which transport the signals (if any) from the threshold circuits 59*a*, 59*b* to the ejecting station or stations at the periphery of the conveyor 32 shown in FIG. 1 in imitation of transport of corresponding portions of the web 13 toward the ejecting station or stations. The outputs of the last stages of shift registers 63*a*, 63*b* are respectively connected with amplifiers 64*a*, 64*b* for the solenoids of valves 66*a*, 66*b* which are installed in the respective branches 69*a*, 69*b* of a pipe 69 having an inlet connected with a source 68 of compressed gas (e.g., an air compressor). The discharge ends of the branches 69*a*, 69*b* are respectively connected with ejector nozzles 67*a*, 67*b* which are adjacent to the path of movement of filter cigarettes FC of unit length along the periphery of the ejecting conveyor 32 of the filter tipping machine.

Figure 2:
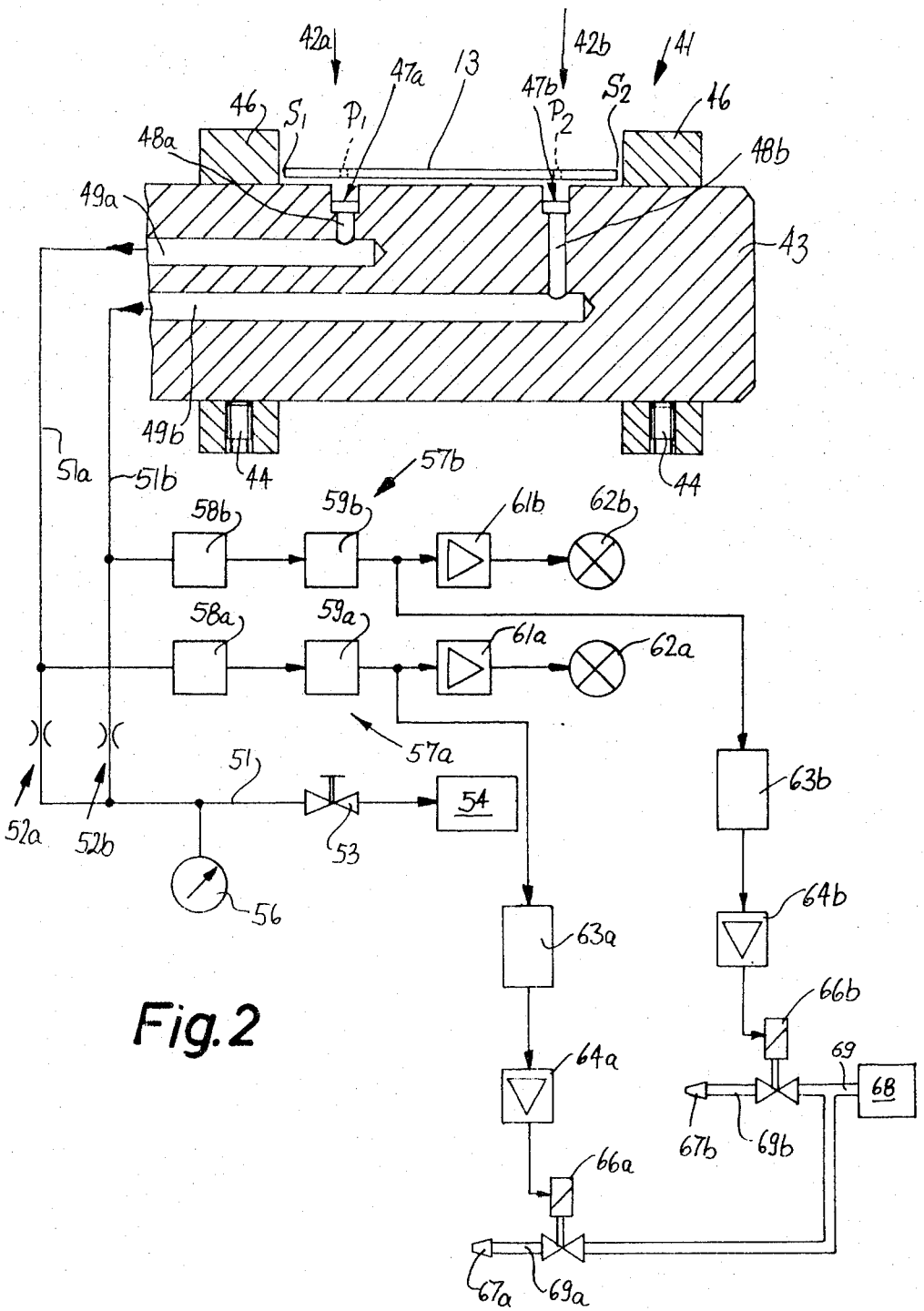
FIG. 2 is a greatly enlarged partly sectional and partly diagrammatic view of an apparatus which embodies one form of the invention and is designed to guide a web of tipping paper along a predetermined path.

The operation of the apparatus of FIG. 2 is as follows:

If the running web 13 contains two discrete rows of perforations P1 and P2 which are located at the desired or optimum distance from the respective marginal portions S1 and S2, the perforations P1 and P2 respectively travel along the grooves 47*a* and 47*b* in the periphery of the stub 43 and the pressure in the bores 48*a*, 48*b*, channels 49*a*, 49*b* and conduits 51*a*, 51*b* matches or closely approximates a desired or optimum pressure. This means that the intensities of signals at the outputs of the transducers 58*a* and 58*b* are not sufficiently pronounced to cause the threshold circuits 59*a* ad 59*b* to transmit signals which would cause the lamps 62*a*, 62*b* to light up and/or the amplifiers 64*a*, 64*b* to energize the solenoids of the respective valves 66*a*, 66*b*, i.e., the nozzles 67*a*, 67*b* remain sealed from the source 68 and the filter cigarettes FC are free to advance past the nozzles 67*a*, 67*b* and on to the upper reach of the take-off conveyor 36 shown in FIG. 1.

It is now assumed that the perforations P1 are missing, that such perforations are not in register with the monitoring device 42*a* (even though the marginal portion S1 is located at the desired or optimum distance from the left-hand flanges 46 of FIG. 2) or that the perforations P1 are too small so that they do not allow a requisite quantity of atmospheric air to flow into the arcuate groove 47*a*. The pressure in the conduit 51*a* then rises and the intensity of signal at the output of the transducer 58*a* suffices to enable the threshold circuit 59*a* to transmit a signal to the light source 62*a* by way of the associated amplifier 61*a*. Thus, the attendant or attendants are warned that the perforations P1 are absent, that the perforations P1 are not disposed at a requisite distance from the respective marginal portion S1 and/or that the perforations P1 are too small. This enables the attendants to replace the respective reel 14 with a reel having satisfactory perforations P1. Furthermore, the output of the threshold circuit 59*a* transmits a signal to the first stage of the shift register 63*a* which transports the signal toward the amplifier 64*a* so that the valve 66*a* opens at the exact moment when the filter cigarette FC embodying the corresponding (defective) portion of the web 13 reaches the ejecting station including the nozzle 67*a*.

The situation is analogous when the monitoring device 42*b* detects the absence of perforations P2, that the perforations P2 are not disposed at a desired distance from the marginal portion S2 and/or that the perforations P2 are too small. The threshold circuit 59*b* then transmits a signal to the lamp 62*b* and to the input of the shift register 63*b* so that the filter cigarette FC embodying the corresponding (defective) portion of the web 13 is ejected during travel past the nozzle 67*b*.

It goes without saying that the lamp 62*a* and/or 62*b* may be replaced by or used in combination with other types of means for generating readily detectable (visible or audible) signals. For example, the lamp 62*a* and/or 62*b* can be replaced with a horn. It is also possible to connect the outputs of the threshold circuits 59*a* and 59*b* with a common signal generating device (such as the lamp 62*a* or 62*b*). The provision of two discrete signal generating devices is preferred at this time because they enable the attendants to ascertain whether the web 13 is defective in the region of the perforations P1 or in the region of the perforations P2.

The same holds true for the nozzles 67*a* and 67*b*, i.e., these nozzles can be replaced with a single nozzle which effects ejection of all defective cigarettes FC irrespective of whether the defects are attributable to absence, to improper positioning and/or to improper size of the perforations P1 or P2.

The shift register 63*a* and/or 63*b* can be replaced with other suitable time-delay means, as long as the nozzles 67*a* and 67*b* receive signals with proper delay, i.e., at the time when the filter cigarettes FC embodying the detected defective portions of the web 13 are located in register with the orifice of the nozzle 67*a* or 67*b*.

The pneumatic apparatus of FIG. 2 can be replaced with an apparatus which employs two photoelectronic monitoring devices. For example, a photoelectronic transducer in combination with a light source can be used as a substitute for the means which establish a pressure differential between the opposite sides of the web 13. The signal at the output of the photoelectronic transducer is then used instead of the signal at the output of the pneumatic-electric transducer 58*a* or 58*b*. For example, the apparatus of FIG. 2 can be modified by utilizing two light sources in the form of gallium arsenide diodes which are placed adjacent to the outer sides of the paths of the perforations P1 and P2. The associated transducers transmit signals to the corresponding threshold circuits 59*a* and 59*b* which can be said to constitute signal comparing means, i.e., each thereof compares the incoming signal (from the respective transducer) with a reference signal and transmits a signal whenever the intensity of the incoming signal is indicative of the absence of perforations, of improper alinement of perforations with the respective monitoring device and/or of unsatisfactory size of detected perforations.

In many instances, the perforations P1 or P2 are not uniform and their distribution in the respective row or rows can also deviate from an optimum distribution. This can take place, for example, when the web 13 is perforated by resorting to one or more lasers or other suitable sources of coherent radiation. The laser or lasers can ensure that the combined cross-sectional area of perforations per unit length of the web 13 is constant or nearly constant even though the distribution of perforations and/or the dimensions of perforations may vary within a rather wide range. The same holds true or is likely to apply if the perforations are made by resorting to spark generating devices.

If the manufacturer is concerned with the appearance of the uniting bands, the apparatus can be readily designed to monitor the rows of perforations with such a high degree of accuracy that detection of improperly distributed perforations or detection of perforations some of which are much smaller or much larger than the majority of perforations can also lead to generation of appropriate signals. If the perforations P1 and/or P2 are applied in such a way that they form two or more rows, accurate monitoring of the perforations might require the utilization of a discrete detector for each and every row of perforations P1 or P2. An evaluation of such signals can lead to generation of further signals which are indicative of combined permeability of two or more rows of perforations P1 and/or P2. The further signals can be compared with reference signals and utilized for segregation of defective cigarettes FC and/or for generation of visible or audible signals if they deviate from the reference signals to an extent which is indicative of monitoring of an unsatisfactory web.

If the perforations P1 and/or P2 form two or more rows, the stub 43 of FIG. 2 can be formed with several arcuate grooves 47*a* and/or 47*b*, and each groove 47*a* or 47*b* can be connected with a discrete transducer corresponding to the transducer 58*a* or 58*b*.

Figure 3:
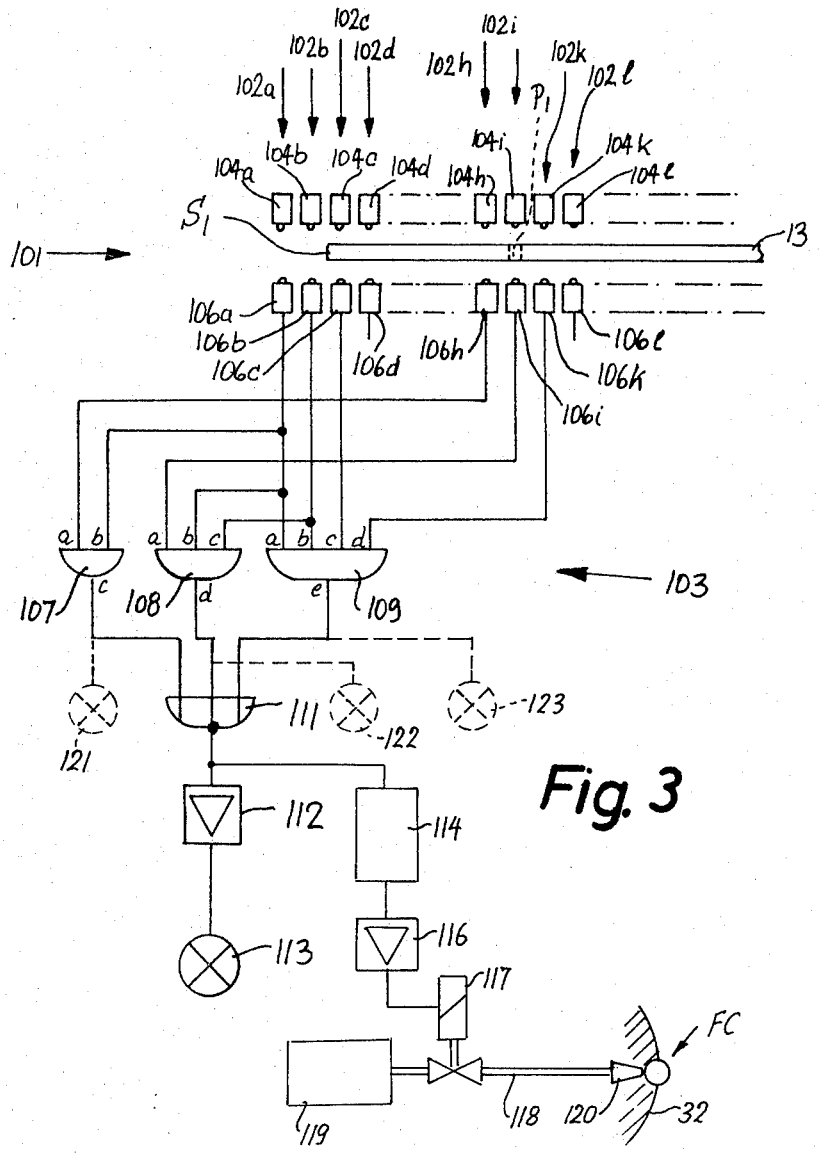
FIG. 3 is a diagrammatic view of a second apparatus which can monitor a web of tipping paper even though the web need not be transported along a predetermined path so that the marginal portions of the web are likely to stray back and forth, as considered at right angles to the direction of lengthwise movement of the web.

FIG. 3 illustrates a modified apparatus 101 which differs from the apparatus of FIG. 2 in that it employs photoelectric cells as a means for monitoring the marginal portions and the perforations of the running web 13. One presently preferred position of the apparatus 101 in the filter tipping machine is indicated in FIG. 1 by phantom lines. Again, the apparatus is located upstream of the paster 18, as considered in the direction of transport of the web 13 toward the conveyor 19, and the paster 18 is again designed in such a way that it does not apply adhesive to those portions of the web 13 which contain or are supposed to contain the perforations (note the aforementioned U.S. Pat. No. 4,249,547 to Hinzmann).

An important difference between the apparatus of FIG. 2 and the apparatus 101 is that the apparatus of FIG. 3 need not employ means for accurately guiding the two marginal portions of the running web 13 along predetermined paths. Instead, the apparatus 101 comprises several pairs of detectors in the form of photocells one of which is supposed to generate signals that denote the position of the marginal portion (one shown at S1 in FIG. 3) of the running web 13 whereas the associated second photocell then tracks the corresponding row of perforations (shown at P1 in FIG. 3). The photocells form a row which extends transversely of the path of the web 13 (i.e., at right angles to the plane of FIG. 1), and their number can be selected practically at will. FIG. 3 shows the detectors or photocells 102*a* . . . 102*l* whose outputs are connected with an evaluating circuit 103. The light emitting senders 104*a* . . . 104*l* of the detectors 102*a* . . . 102*l* are located at one side of the path for the web 13, and the corresponding photosensitive transducers 106*a* . . . 106*l* are located at the opposite side of such path. For example, each of the senders 104*a* . . . 104*l* can constitute a gallium arsenide luminescent diode of the type CQY 39 manufactured and sold by the West German firm AEG-Telefunken, and each of the transducers 106*a* . . . 106*l* may be of the type known as BPW 19 (namely, a silicon-NPN-epitaxial-planar-phototransistor) manufactured by AEG-Telefunken.

In the apparatus 101 which is actually shown in FIG. 3, three of the detectors (namely, the detectors 102*a*, 102*b*, 102*c*) are used to track the position of the marginal portion S1, and three detectors (namely, the detectors 102*h*, 102*l*, 102*k*) are assumed to cooperate with the detectors 102*a*, 102*b*, 102*c* to monitor the position of the row of perforations P1. It is clear that the number of detectors which track the position of the marginal portion S1 can be increased to four or more, and the number of detectors which track the corresponding row of perforations P1 is then increased accordingly. The number of detectors which respectively track the marginal portion S1 and the corresponding perforations P1 will be selected in dependency on anticipated or normal deviation of the actual path of the marginal portion S1 from the anticipated or desired (optimum) path. It is further clear that, if the web 13 of FIG. 3 is also provided with two rows of perforations, the apparatus 101 of FIG. 3 is modified accordingly so that it employs a requisite number of detectors for tracking the other marginal portion of the web 13 and an equal number of detectors to track the position of the second row of perforations with reference to the nearest (non-illustrated) marginal portion.

The operation and construction of the apparatus 101 of FIG. 3 are based on the premise that, if the perforations P1 are located at a proper distance from the marginal portion S1, it is immaterial whether the marginal portion S1 travels to the left or to the right of the anticipated path therefor, as long as the perforations P1 are located at the requisite distance therefrom.

The evaluating circuit 103 comprises an AND gate (107, 108, 109) for each of the three detectors 102*a*, 102*b*, 102*c* which track the position of the marginal portion S1. The AND gate 107 is further connected with the detector 102*h* which is supposed to detect the presence of perforations P1 if the detector 102*a* ascertains the presence of the marginal portion S1. The three inputs of the AND gate 108 are connected with the transducers 106*a*, 106*b* and 106*i* (the transducer 106*i* is supposed to transmit signals denoting the detection of perforations P1 if the transducer 106*b* transmits a signal denoting detection of the marginal portion S1). The AND gate 109 has four inputs which are connected with the transducers 106*a*, 106*b*, 106*c* and 106*k* (the transducer 106*k* is supposed to transmit a signal denoting detection of the perforations P1 if the transducer 106*c* transmits a signal denoting detection of the corresponding marginal portion S1).

The outputs of the AND gates 107, 108 and 109 are connected with the corresponding inputs of an inverter 111 whose output is connected with an amplifier 112 for a light source 113. If desired, the output of the inverter 111 can be further connected with the first stage of a time delay device 114 here shown as a shift register which transports a signal in imitation of travel of a filter cigarette FC toward the ejecting station adjacent to the periphery of the conveyor 32. The last stage of the shift register 114 transmits signals to a solenoid-operated valve 117 by way of an amplifier 116. The valve 117 is installed in a pipe or conduit 118 connecting a source 119 of compressed gaseous fluid with an ejector nozzle 120 for defective filter cigarettes FC. The light source (lamp) 113 can be replaced with a device for generating audible signals, or a device for the generation of audible signals can be used in addition to the lamp 113.

It is now assumed that the row of perforations P1 is located at a proper distance from the nearest marginal portion S1 of the running web 13 of tipping paper. Barring excessive deviations of the path of the marginal portion S1 from the desired or anticipated path, the marginal portion S1 must be detected by one of the three detectors 102*a*, 102*b*, 102*c*. Consequently, and since the distance between the perforations P1 and the marginal portion S1 is assumed to be satisfactory, the perforations P1 must be detected by one of the detectors 102*h*, 102*i*, 102*k*. The output c of the AND gate 107 does not transmit a signal because, though its input b receives a signal from the transducer 106*a* (the latter is capable of reacting to light which is emitted by the associated source 104*a* because the marginal portion S1 is located to the right of the detector 102*a*), the input a of the AND gate 107 does not receive a signal from the output of the transducer 106*h* because a non-perforated portion of the web 13 travels between the transducer 106*h* and the corresponding light source or sender 104*h*.

The output e of the AND gate 109 also fails to transmit a signal to the corresponding input of the inverter 111 because, though the input a of the gate 109 receives a signal from the transducer 106*a* (there is no interception of light between the transducer 106*a* and the associated light source 104*a*), the input b of the gate 109 receives a signal from the transducer 106*b* (the marginal portion S1 is located between the detectors 102*b* and 102*c*), the inputs c and d of the gate 109 do not receive signals from the respective transducers 106*c* and 106*k* (because the web 13 intercepts light between the transducer 106*c* and the associated light source 104*c* as well as between the detector 106*k* and the associated light source 104*k*).

However, the output d of the AND gate 108 transmits a signal to the corresponding input of the inverter 111 because its input a receives a signal from the transducer 106*i* (which is exposed to light issuing from the associated source 104*i* and passing through the perforations P1), the input b of the gate 108 receives a signal from the transducer 106*a* for the reasons which were explained above, and the input c of the gate 108 receives a signal from the transducer 106*b*, again for the reasons which were discussed above. Consequently, the output of the converter 111 does not transmit a signal to the amplifier 112 and to the first stage of the shift register 114. This means that the lamp 113 does not generate a signal and the filter cigarette FC whose wrapper embodies the corresponding (freshly monitored) portion of the web 13 is not ejected during travel past the nozzle 120.

An examination of connections between the detectors 102*a*–102*l* and the AND gates 107–109 will reveal that the inputs of the inverter 111 do not receive a signal if the distance between the marginal portion S1 and the row of perforations P1 is unsatisfactory. At such time, the output of the inverter 111 transmits a signal to the amplifier 112 so that the lamp 113 lights up and the attendant is informed that the corresponding reel 14 (see FIG. 1) must be removed because the row of perforations P1 in such reel is not located at a requisite distance from the marginal portion S1. At the same time, the output of the inverter 111 transmits a signal to the shift register 114 which, with due delay, varies the valve 117 to effect ejection of all filter cigarettes FC with convoluted uniting bands having perforations P1 disposed at an excessive or insufficient distance from the nearest marginal portion S1.

The apparatus of FIG. 3 can be used with advantage in machines which are not designed for convenient installation of apparatus of the type shown in FIG. 2. As a rule, the guide means 41 or analogous means for guiding the web 13 in such a way that its marginal portions S1 and S2 are normally transported along predetermined paths can be installed only when the next guide or deflecting means is located at a certain distance therefrom. With reference to FIG. 1, the guide means 41 must be installed at a certain distance from the rolls 15*a* and 15*b* in order to allow for proper guidance of the marginal portions S1 and S2 by the corresponding flanges 46 on the stub 43 shown in FIG. 2. If there is no room for mounting of the guide means 41 at or beyond a given minimum distance from the rolls 15*a* and 15*b*, the apparatus 101 is or can be utilized in lieu of the apparatus of FIG. 2 because it is capable of ascertaining the distance between the marginal portions and the rows of perforations since it need not rely on guidance of the marginal portions along predetermined paths but rather provides for automatic monitoring of the assumed or probable path of perforations at a given distance from the nearest or selected marginal portion. Consequently, once the marginal portion is detected, the photocell which is associated with the photocell that has detected the marginal portion must detect the perforations, or vice versa.

If the perforations P1 of the web 13 shown in FIG. 3 form two or more rows, each such row can be monitored in a manner as explained hereinbefore in connection with FIG. 2, i.e., by providing the stub 43 with a discrete groove 47*a* or 47*b* for each row of perforations. However, it is normally preferred to monitor such webs in an apparatus which constitutes a modification of the apparatus 101, i.e., by resorting to detectors in the form of photocells or the like. A large number of photocells can be placed close to each other so that each photocell can monitor a discrete row of perforations when the associated photocell or photocells monitor the remaining row or rows of perforations and while a further photocell tracks the marginal portion S1. In a way, the just discussed modified apparatus of FIG. 3 would resemble apparatus which are used by banks to monitor cancelled checks or by many other institutions which employ photoelectronic monitoring means for information bearing bodies in the form of tapes, strips or webs having one or more rows of perforations therein. The just discussed modified apparatus can ascertain the condition of perforations in each row, the presence or absence of perforations as well as the distance between the perforations and the nearest marginal portion or a selected marginal portion.

It is further within the purview of the invention to utilize the apparatus 101 of FIG. 3 in combination with the guide means 41 of FIG. 2. The thus modified apparatus 101 is then capable of generating signals denoting the extent of deviation of the path of marginal portion S1 from the desired or optimum path. This will be readily appreciated by looking at FIG. 3 which shows, by broken lines, light sources 121, 122, 123 connected with the outputs c, d and e of the AND gates 107, 108 and 109, respectively. If the path of the marginal portion S1 is satisfactory when the output c of the AND gate 107 transmits a signal, the associated light source 121 lights up and the attendant is apprised that the path of the marginal portion S1 coincides with the desired or optimum path. If the light source 122 transmits a signal, the attendant knows that the path of the marginal portion S1 deviates from the optimum path by a distance corresponding to that between the detectors 102*a*, 102*b*. If the light source 123 transmits a signal, the attendant knows that the deviation of the path for the marginal portion S1 from the desired optimum path equals the distance between the detectors 102*a* and 102*c*.

Furthermore, it is equally possible to use only the detectors 102*a*–102*l*, the gates 107–109 and the light sources 121–123 of FIG. 3 in combination with the apparatus of FIG. 2. The apparatus of FIG. 2 then monitors the distance between the marginal portions S1, S2 and the respective rows of perforations P1, P2, and the parts 102*a*–102*l*, 107, 108, 109, 121, 122, 123 generate signals denoting the location of the marginal portion S1 or S2 with reference to the optimum location (as considered transversely of the direction of lengthwise transport of the web 13).

The just described modified apparatus of FIG. 2 can be used to automatically change the path for the web 13 when such path deviates from the optimum path, for example, by causing a servomotor to move the collars or flanges 46 lengthwise of the stub 43 in a direction to the right or to the left, depending on the direction and extent of deviation of the path of monitored marginal portion S1 or S2 from the desired or optimum path. The importance or desirability of adequate guidance of the web 13 in its path (so that the marginal portions S1 and S2 will travel along the prescribed paths) will be readily appreciated by bearing in mind that the paster 18 is not supposed to supply adhesive to those portions of the running web 13 which are formed with perforations P1 and P2. It goes without saying that, instead of or in addition to changing the position of the web 13 when the paths of the marginal portions S1 and S2 deviate from desired or optimum paths, it is equally possible to shift the applicator 18*a* of the paster 18 in directions at right angles to the plane of FIG. 1 with the same result, i.e., the applicator 18*a* should not apply adhesive to those portions of the web 13 which are formed with the performations P1 and P2. This reduces the number of rejects because the testing unit which includes the conveyor 37 of FIG. 1, or a discrete testing unit, detects the absence of perforations P1 or P2 (or the presence of clogged perforations) in the finished filter cigarettes FC of unit length and initiates the segragation of such filter cigarettes from satisfactory articles.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the appended claims.

I claim:

1. A method of processing a running web of wrapping material having at least one row of perforations which are normally disposed at a given distance from a marginal portion of the web, particularly of processing a running web of tipping paper in a filter tipping machine ahead of the station at which at least one selected portion of one side of the web is coated with adhesive, comprising the steps of transporting the marginal portion of the web lengthwise along a predetermined path so that those perforations which are located at said given distance from the marginal portion advance along a second path separated from said predetermined path by said given distance; monitoring the distance between the marginal portion and the row of perforations in the running web, including scanning said second path for the presence of perforations; and automatically generating a signal on detection of the absence of perforations in said second path.

2. The method of claim 1, wherein said scanning step includes establishing a pressure differential between the opposite sides of the running web, at least in the region which is disposed at said given distance from the marginal portion, whereby the pressure differential deviates from a predetermined value in the absence of perforations or in the presence of unsatisfactory perforations in said region, and monitoring said pressure differential, said signal generating step including generating a signal whenever the monitored pressure differential diveiates from said predetermined value.

3. The method of claim 2, wherein said step of establishing a pressure differential includes normally maintaining the pressure at one side of the running web below atmospheric pressure.

4. The method of claim 2, wherein the step of monitoring said pressure differential includes ascertaining the actual pressure differential in said region and comparing the ascertained pressure differential with said predetermined value.

5. The method of claim 1 of processing a running web having a plurality of rows of perforations including a second row of perforations normally located at a second given distance from said marginal portion, further comprising the steps of monitoring the distance between said second row of perforations and said marginal portion and automatically generating a discrete second signal when the distance between said marginal portion and said second row of perforations deviates from said second given distance.

6. The method of claim 1, further comprising the steps of coating said selected portion of one side of the monitored web with adhesive, converting the coated web into a series of uniting bands, draping successive uniting bands of said series around rod-shaped articles to form a succession of smokers' products, conveying the smokers' products along a second predetermined path, and utilizing said signals for segregation from said second predetermined path of smokers' products containing uniting bands whose monitoring resulted in the generation of the respective signals.

7. The method of claim 1 of processing a running web of wrapping material having a second marginal portion and at least one second row of perforations which are normally disposed at a second given distance from said second marginal portion, further comprising the steps of monitoring the distance between said second row of perforations and said second marginal portion, and generating a second signal when the monitored distance between the second row of perforations and the second marginal portion deviates from said second given distance.

8. The method of claim 7, wherein said second given distance matches or closely approximates said first mentioned given distance.

9. Apparatus for processing a running web of wrapping material having at least one row of perforations which are normally disposed at a given distance from a marginal portion of the web, particularly for processing a running web of tipping paper in a filter tipping machine ahead of a station where at least one selected portion of one side of the web is coated with adhesive, comprising guide means for the running web, said guide means being operative to maintain the marginal portion of the running web in a first predetermined path and to maintain the row of perforations in a second path which is normally located at said given distance from said first path; means for monitoring the distance between the marginal portion and the row of perforations in the running web, said monitoring means being adjacent to said second path and including means for establishing a pressure differential at the opposite sides of the web portion advancing along said second path so that the presence, absence or nature of perforations influences the extent of pressure differential, said means for establishing said pressure differential including a device for generating a pressure deviating from atmospheric pressure and said guide means having a groove provided in the region of said second path and connected with said device so as to induce the flow of air through the perforations which register with said groove; and means for automatically generating a signal when the monitored distance between the row of perforations and the marginal portion of the running web deviates from said given distance, said signal generating means being operative to monitor the pressure differential and to generate a signal when the monitored pressure differential is outside of a predetermined range.

10. The apparatus of claim 9, wherein said signal generating means is operative to generate a signal when said monitoring means fails to detect perforations in said second path.

11. The apparatus of claim 10, wherein said guide means includes means for changing the direction of lengthwise movement of the running web.

12. The apparatus of claim 9, further comprising conduit means connecting said device with said groove, said signal generating means including transducer means installed in said conduit means.

13. The apparatus of claim 9 for processing a running web having a second row of perforations normally disposed at a second distance from the marginal portion of the web, further comprising second monitoring means for monitoring the distance between the marginal portion and the second row of perforations, and means for automatically generating a discrete second signal when the monitored distance between the second row of perforations and the marginal portion of the running web deviates from said second distance.

14. The apparatus of claim 9 for processing a running web which is subsequently converted into web portions each of which forms part of a discrete rod-shaped article, particularly filter cigarette, which is conveyed along a predetermined path, further comprising means for expelling from said path, in response to each signal, that article which embodies the web portion that has caused the generation of the respective signal.

15. The apparatus of claim 9, wherein each of said signals is a visible signal.

16. The apparatus of claim 9, wherein monitoring means includes means for discriminating between perforations of different sizes and shapes.

17. The apparatus of claim 9, wherein said monitoring means includes a plurality of discrete detectors.

* * * * *

UNITED STATES PATENT AND TRADEMARK OFFICE

CERTIFICATE OF CORRECTION

PATENT NO. : 4,383,435

DATED : May 17, 1983

INVENTOR(S) : Alfred HINZMANN

It is certified that error appears in the above-identified patent and that said Letters Patent are hereby corrected as shown below:

Col. 1, line 60, "wth" should read --with--.
Col. 3, line 57, "whch" should read --which--.
Col. 4, line 3, "filer" should read --filter--.
Col. 17, line 45, "converter" should read --inverter--;
line 64, "varies" should read --causes--.
Col. 19, line 42, "37" should read --31--.

Signed and Sealed this

*Twenty-third* Day of *July 1985*

[SEAL]

*Attest:*

DONALD J. QUIGG

*Attesting Officer* *Acting Commissioner of Patents and Trademarks*